US009095196B2

(12) United States Patent
Leung

(10) Patent No.: US 9,095,196 B2
(45) **Date of Patent: *Aug. 4, 2015**

(54) HAIR STYLING APPARATUS

(71) Applicant: Conair Corporation, Stamford, CT (US)

(72) Inventor: Anthony Kit Lun Leung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/313,331

(22) Filed: Jun. 24, 2014

(65) Prior Publication Data

US 2014/0305465 A1 Oct. 16, 2014

Related U.S. Application Data

(63) Continuation of application No. 13/713,444, filed on Dec. 13, 2012, now Pat. No. 8,757,175.

(51) Int. Cl.

| | |
|---|---|
| ***A45D 2/00*** | (2006.01) |
| ***A45D 1/04*** | (2006.01) |
| *A45D 1/00* | (2006.01) |

(52) U.S. Cl.

CPC *A45D 2/001* (2013.01); *A45D 1/04* (2013.01); *A45D 2001/008* (2013.01); *A45D 2200/207* (2013.01)

(58) Field of Classification Search

USPC ..... 132/221, 224–229

See application file for complete search history.

(56) References Cited

U.S. PATENT DOCUMENTS

| | | | |
|---|---|---|---|
| 5,781,691 | A | 7/1998 | Kwok |
| 5,875,789 | A | 3/1999 | Shigihara |
| 5,983,903 | A | 11/1999 | Nanba et al. |
| 6,029,677 | A | 2/2000 | Nanba et al. |
| 6,053,178 | A | 4/2000 | Todd |
| 6,119,702 | A | 9/2000 | Habibi |
| 6,191,387 | B1 | 2/2001 | Smal |
| 6,196,236 | B1 | 3/2001 | Imai et al. |
| 6,325,072 | B1 | 12/2001 | Smetana |
| 6,526,988 | B2 | 3/2003 | Takehana |
| 6,584,985 | B2 | 7/2003 | Omura |
| 6,701,937 | B2 | 3/2004 | Janouch et al. |
| 6,802,320 | B2 | 10/2004 | Janouch et al. |
| RE38,713 | E | 3/2005 | Habibi |

(Continued)

OTHER PUBLICATIONS

The International Search Report for corresponding International Application No. PCT/US13/74937, dated Jan. 17, 2014, 3 pages.

*Primary Examiner* — Rachel Steitz

(74) *Attorney, Agent, or Firm* — Carter, DeLuca, Farrell & Schmidt, LLP

(57) ABSTRACT

A hair styling apparatus includes first and second handle members adapted for movement between an open position for receiving hair therebetween and a closed condition adjacent the hair, a heating element associated with at least one of said first and second handle members and a cartridge mountable to said first handle member and having a hair treatment agent for dispensing and treating hair disposed between the first and second handle members. The treatment agent may include a conditioning, strengthening, repairing or revitalizing fluid. An ultrasonic transducer may be associated with said cartridge. The transducer is actuable to heat the treatment agent to affect at least partial vaporization thereof for release adjacent the heating elements and application to the hair.

18 Claims, 6 Drawing Sheets

(56) References Cited

U.S. PATENT DOCUMENTS

| | | | | |
|---|---|---|---|---|
| 6,941,955 | B2 | 9/2005 | Yao | |
| 7,178,531 | B2 | 2/2007 | Carballada et al. | |
| 7,296,581 | B2 | 11/2007 | Gold | |
| 7,325,551 | B2 | 2/2008 | Henninger et al. | |
| 7,341,064 | B2 | 3/2008 | Habibi | |
| 7,380,556 | B2 | 6/2008 | Carballada et al. | |
| 7,465,904 | B2 | 12/2008 | Kim et al. | |
| 7,478,640 | B2 | 1/2009 | Saida et al. | |
| 7,540,289 | B2 | 6/2009 | Habibi | |
| 7,597,107 | B2 | 10/2009 | Imai et al. | |
| 7,958,897 | B2 | 6/2011 | Uchinashi | |
| 2005/0172979 | A1* | 8/2005 | Saida et al. | 132/228 |
| 2008/0072921 | A1 | 3/2008 | Habibi | |
| 2008/0283080 | A1 | 11/2008 | Habibi | |
| 2008/0283081 | A1 | 11/2008 | Habibi | |
| 2009/0266378 | A1 | 10/2009 | Nunomura | |
| 2009/0288675 | A1 | 11/2009 | Nunomura | |
| 2010/0212683 | A1 | 8/2010 | Mizuno | |
| 2011/0079238 | A1 | 4/2011 | Takehana | |
| 2011/0108051 | A1 | 5/2011 | Yahnker et al. | |
| 2012/0312319 | A1 | 12/2012 | Uwano | |
| 2013/0192625 | A1* | 8/2013 | Migliori et al. | 132/211 |

* cited by examiner

HAIR STYLING APPARATUS

CROSS REFERENCE TO RELATED APPLICATIONS

This application is a continuation of U.S. patent application Ser. No. 13/713,444 filed on Dec. 13, 2012. The entire contents of which is incorporated herein by reference.

BACKGROUND

1. Technical Field

The present disclosure relates to an apparatus for treating hair, and, more particularly, relates to a hair styling apparatus incorporating a cartridge with an ultrasound transducer for heating and at least partially vaporizing a hair treatment agent dispensable from the cartridge.

2. Background of the Related Art

Hair straightener apparatii typically include two pivotal handles which are hinged at one end and pivot about the hinge between open and closed positions. Heating heads extend from each handle and have inner surfaces comprised of a heatable material, usually metal, for straightening or styling hair. An electric heater element located beneath each heatable surface is activated to warm the surfaces to a desired temperature. The inner surfaces are positionable around hair to be styled, and the hinged handles are moved to a closed position bringing the heated inner surfaces in contact with the hair. The gripped handles are then slid along the hair strands until the hair exits from the heads. One example of a hair straightener apparatus is disclosed in commonly assigned U.S. Pat. No. 7,178,532, the entire contents of which are incorporated by reference herein.

SUMMARY

Accordingly, the present disclosure is directed to further enhancements in hair straightener apparatti. In accordance with one embodiment, a hair styling apparatus includes first and second handle members adapted for movement between an open position for receiving hair therebetween and a closed position adjacent the hair, a heating element associated with at least one of the first and second handle members and a cartridge mountable to the first handle member and having a hair treatment agent for dispensing and treating hair disposed between the first and second handle members. The treatment agent may include a conditioning, strengthening, repairing or revitalizing fluid.

An ultrasonic transducer may be associated with the cartridge. The transducer is actuable to heat the treatment agent to affect at least partial vaporization thereof for release adjacent the heating elements and application to the hair. The cartridge may define a cartridge vapor outlet with the transducer being positioned adjacent the cartridge vapor outlet. The transducer may have channels for permitting the at least partially vaporized treatment agent to pass through the transducer and the cartridge vapor outlet.

The heating element of the at least one of the first and second handle members may define a channel, which is positioned adjacent the cartridge outlet to convey vaporized treatment agent along the heating element. In one embodiment, the first and second handle members include respective first and second heating elements with each the heating element having the channel for conveying the vaporized treatment agent.

A manually actuated ultrasonic power switch for selectively activating and deactivating the transducer. The cartridge may include electrical contacts in electrical communication with the transducer, and wherein the first handle member includes corresponding handle contacts for engaging the electrical contacts of the cartridge for supplying power to the transducer.

The cartridge may be dimensioned and adapted for releasable mounting to the first handle member. A cartridge release member may be mounted to the first handle member. The cartridge release member is movable to cause release of the cartridge from the first handle member. The cartridge may include a cover, which is movable between an open condition to permit introduction of the treatment agent within the cartridge and a closed position. The cartridge may define an internal chamber for accommodating the treatment agent. An absorbent member may be disposed within the internal chamber for containing the treatment agent. The absorbent member is adjacent the transducer whereby heat generated by the transducer causes at least partial vaporization of the treatment agent within the absorbent member. In embodiments, a container having the treatment agent is releasably mountable to the cartridge.

BRIEF DESCRIPTION OF THE DRAWINGS

Various embodiments of the present disclosure are described hereinbelow with references to the drawings, wherein.

DETAILED DESCRIPTION OF THE PREFERRED EMBODIMENTS

Figures 1, 2:
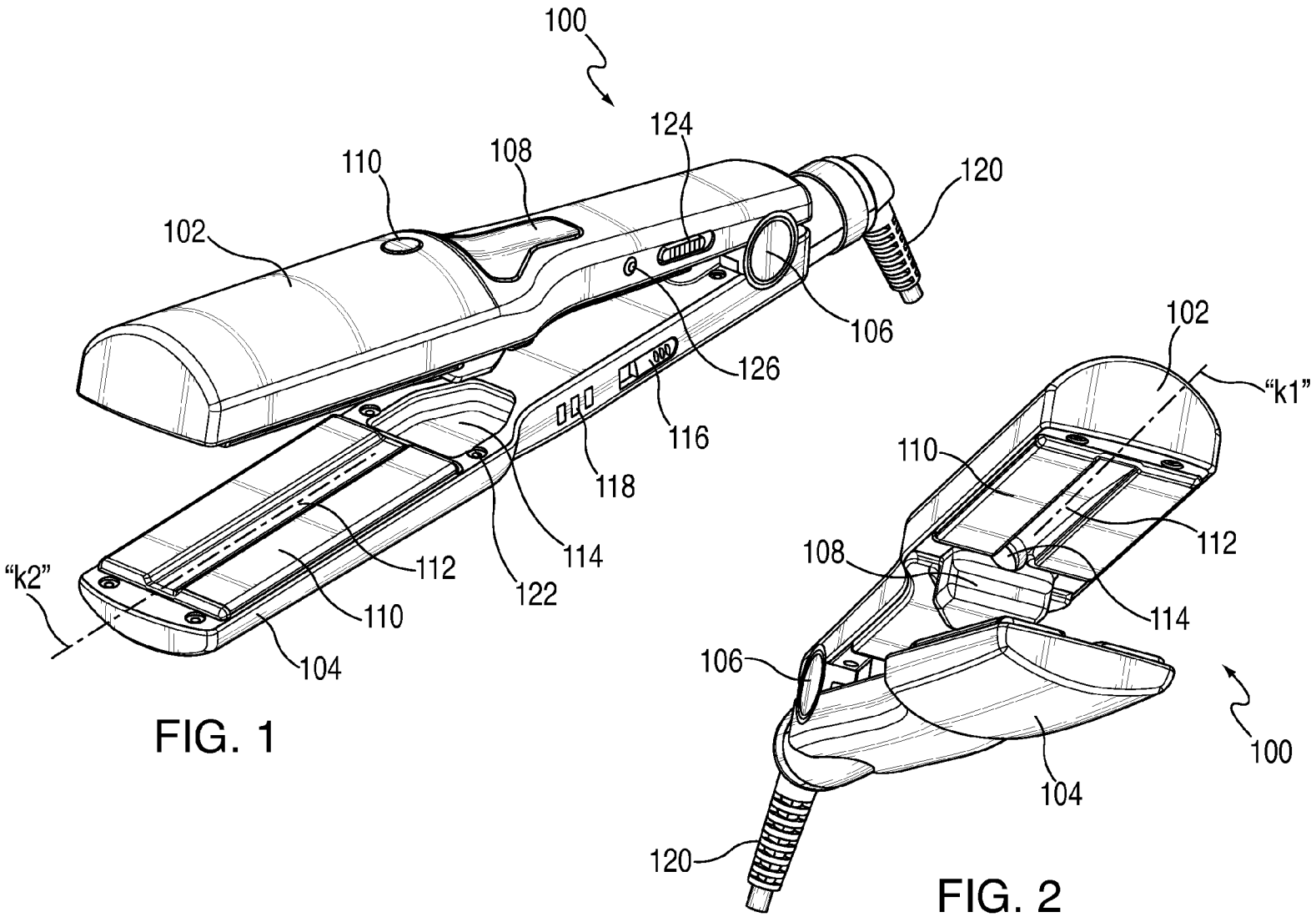
FIGS. 1-2 are perspective views of a hair styling apparatus in accordance with the principles of the present disclosure illustrating the first and second handle members and the cartridge mounted to the first handle member.
Figure 3:
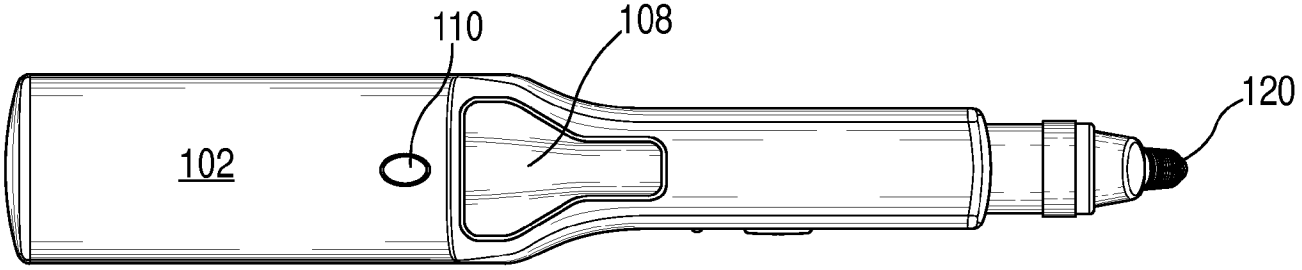
FIGS. 3-5 are top plan, side elevation and axial views, respectively of the hair styling apparatus.
Figure 4:
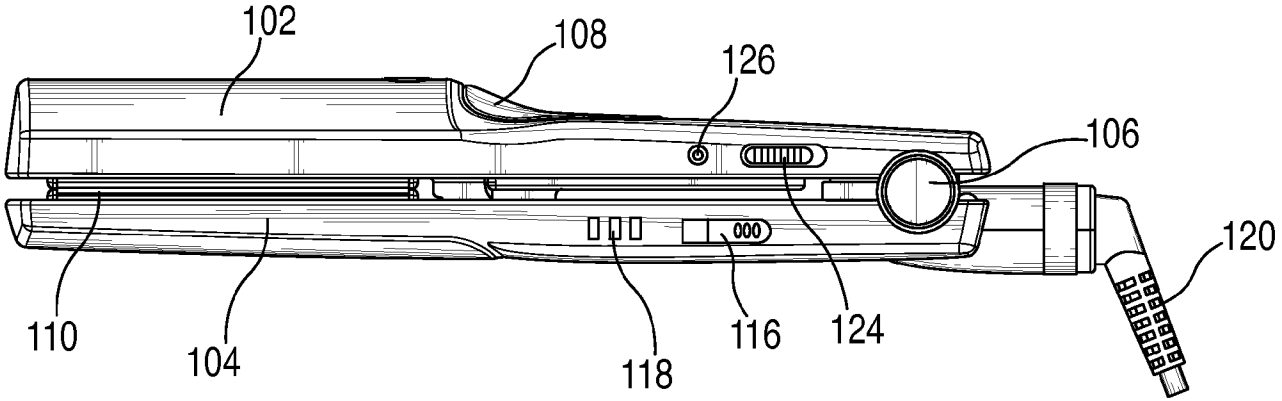
Figure 5:
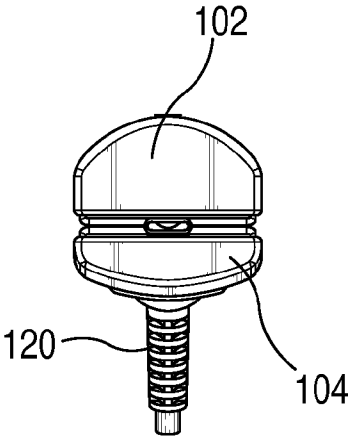

Referring now in detail to the drawings and, in particular, to FIGS. 1-5, the hair styling apparatus 100 in accordance with the principles of the present invention is illustrated. The hair styling apparatus 100 may be in the form of a hair straightener utilized to generally straighten the hair of the subject. However, it is envisioned that the hair styling apparatus may includes surfaces to shape, crimp or affect any styling effect to the subject's hair.

The hair styling apparatus 100 includes first and second handle members 102,104 connected to each other through a hinge 106, of a conventional type. The hinge 106 typically incorporates a spring to normally bias the first and second members 102, 104 to the open position depicted in FIGS. 1 and 2. The first and second handle members 102, 104 are adapted to pivot about the hinge 106 between the open position of FIGS. 1 and 2 and the closed position depicted in FIGS. 3-5. The first handle member 102 includes a cartridge 108 and a cartridge release button 110, which releases the cartridge 108 from the first handle member 102. Generally, the cartridge 108 contains a hair treatment agent, which is released in an at least partially vaporized state, between the first and second handle members 102, 104 for application to the subject's hair. The cartridge 108 will be discussed in greater detail hereinbelow.

Each of the first and second handle members 102, 104 includes a heating element or plate 110 at the end remote from the hinge 106. The heating plates 110 are heated by conventional electrical means (not shown) known in the art, so that hair can be positioned therebetween for styling. Each heating plate 110 includes a centrally disposed channel 112 respectively extending lengthwise or longitudinally with respect to the longitudinal axes "k1, k2" of the respective handle members 102, 104. The channels 112 may be offset with respect to the respective axes "k1, k2", may be non-linear, arcuate, sinusoidal or any other shape. The channels 112 convey the at least partially vaporized treatment agent, which is released from the cartridge 108 within the heating plates 110 for application to the hair of the subject. The second handle member 104 includes a pocket or recess 114 (FIG. 1), which is dimensioned to correspondingly accommodate at least a segment of the cartridge 108 when the first and second handle members 102, 104 are in the closed position.

The first and second handle members 102, 104 may include an on/off power switch 116, a power-on indicator or light 118 (such as an LED indicator or the like) for indicating activation of the apparatus 100 and a power cord 120 for supplying power. Contacts 122 on each of the first and second handle member 102, 104 may be provided to power the heating plates only when the first and second handle members 102, 104 are in the closed position. The first handle member 102 further includes an ultrasound power switch 124 and an ultrasound power indicator 126 such as an LED or the like—the function of which will be discussed in greater detail herein below.

Figure 6:
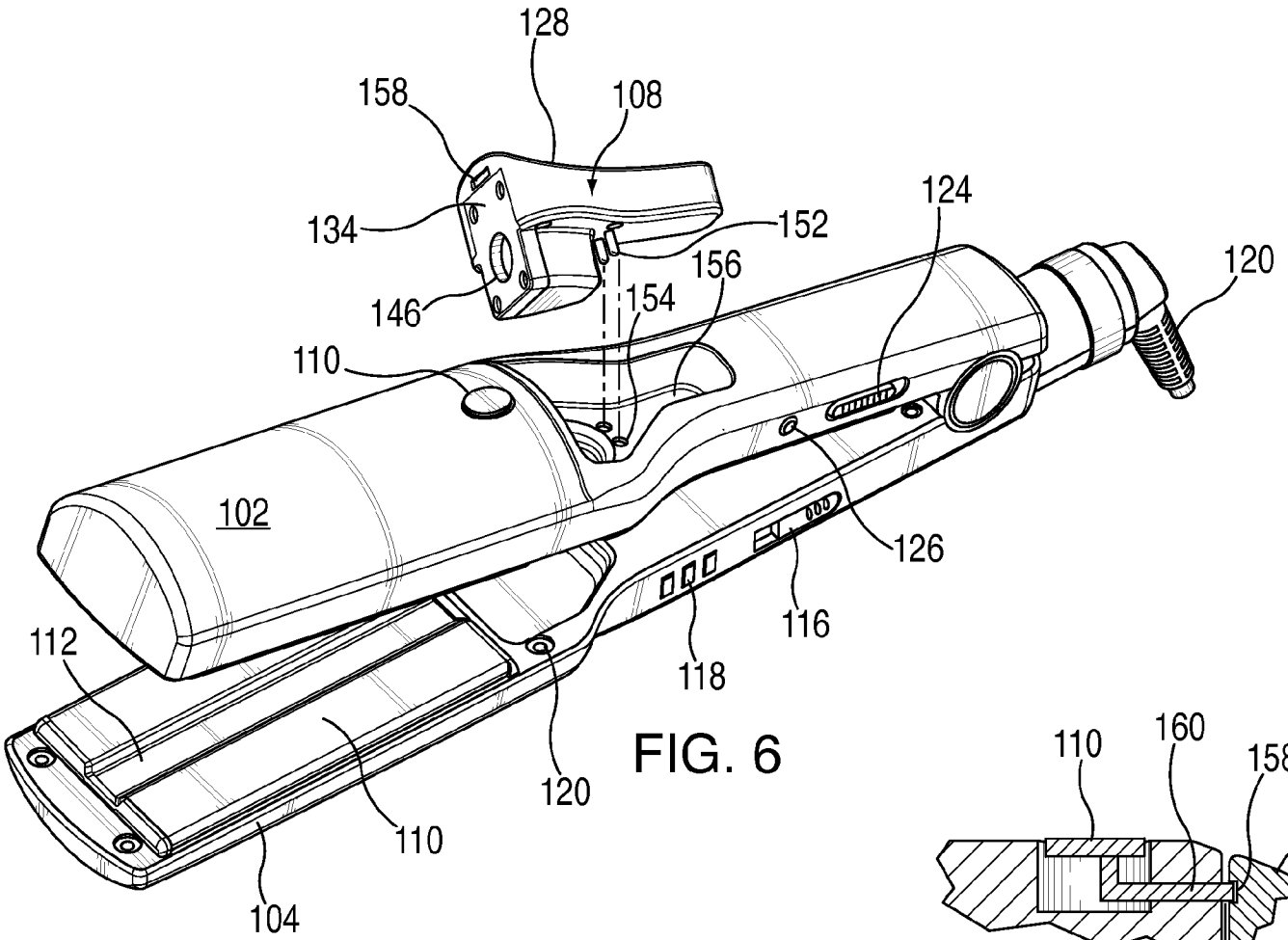
FIG. 6 is a perspective view of the hair styling apparatus illustrating the cartridge removed.
Figure 7:
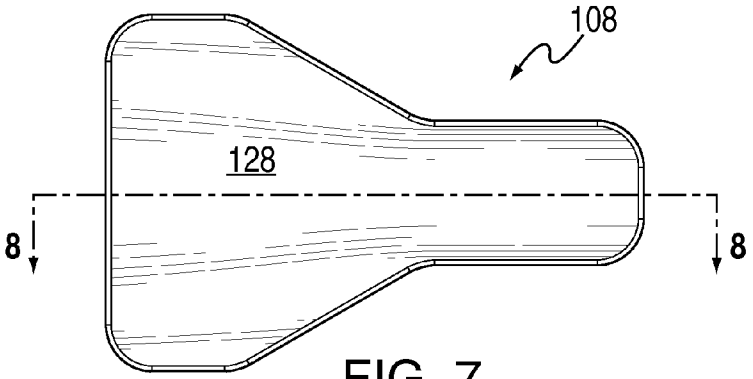
FIG. 7 is a top plan view of the cartridge.
Figure 8:
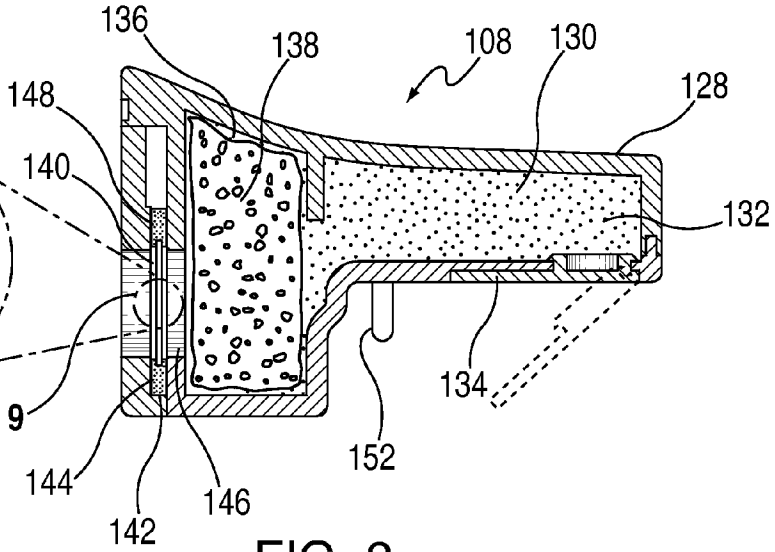
FIG. 8 is a side cross-sectional view of the cartridge taken along the lines 8-8 of FIG. 7.
Figure 9:
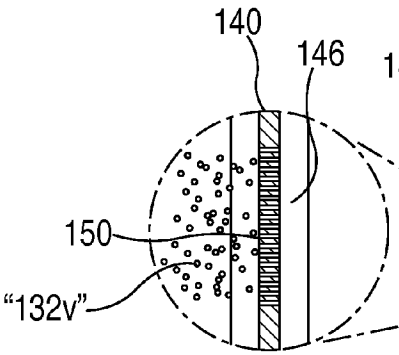
FIG. 9 is an enlarged isolated view of the area of detail designated in FIG. 8.

Referring now to FIG. 6, in conjunction with FIGS. 7-9, the cartridge 108 will be discussed in detail. The cartridge 108 includes a cartridge housing 128 having a first internal chamber 130 defining a reservoir for accommodating the treatment agent 132. The treatment agent may be argan oil. Argan oil is extracted from the fruits of the argan tree, *argania spinosa,* that is endemic to Morocco. The hair care composition may solely contain argan oil, or may include argan oil in combination with other ingredients. Examples of other ingredients include pharmaceutically active agents, moisturizers, hydration agents, penetration agents, preservatives, emulsifiers, natural or synthetic oils, solvents, surfactants, detergents, gelling agents, emollients, antioxidants, fragrances, fillers, thickeners, waxes, odor absorbers, dyestuffs, coloring agents, powders, viscosity-controlling agents, buffers, protectants, pH regulators, chelating agents, humectants, conditioners, glitter, mica, minerals, silicones, polyphenols, sunblocks, phytomedicinals, and combinations thereof, as well as other additives typically used in hair care products as appreciated by those skilled in the art.

In embodiments, the hair care composition may include argan oil and emollients and/or conditioning agents, alone or in combination with other ingredients as discussed above. In embodiments, the hair care composition includes argan oil and silicone. Silicone includes, for example, silicone oils and oils having a hydrocarbon backbone, silicone oils combining cyclic polydimethylsiloxanes, α,ω-hydroxylated polydimethylsiloxanes, α,ω-trimethylsilyl polydimethylsiloxanes, polyorganosiloxanes such as polyalkylmethylsiloxanes, polymethylphenylsiloxanes, polydiphenylsiloxanes, aminosilicone derivatives, silicone waxes, copolyether silicones (such as the oil MIRASIL DMCO sold by Rhone-Poulenc, or DC 190 sold by Dow Corning) or mixed silicone derivatives including various types of derivatization (such as polyalkylmethyl-siloxane/copolyether silicone mixed copolymers). An argan/silicon conditioning agent may strengthen, repair or condition hair, while potentially adding shine to the hair.

Other suitable emollients include, for example alkylmonoglycerides, alkyldiglycerides, and/or triglycerides such as oils extracted from plants and vegetables (palm oil, coconut oil, cotton seed oil, soybean oil, sunflower oil, olive oil, grape seed oil, sesame oil, ground nut oil, castor oil, combinations thereof, and the like), oils of marine origin (fish oils, etc.) and derivatives of these oils, such as hydrogenated oils, lanolin derivatives, mineral oils or paraffinic oils, perhydrosqualane, squalene, diols such as 1,2-propanediol and 1,3-butanediol, cetyl alcohol, stearyl alcohol, oleyl alcohol, polyethylene glycols or polypropylene glycols, and fatty esters such as isopropyl palmitate, 2-ethylhexyl cocoate, myristyl myristate, esters of lactic acid, stearic acid, behenic acid, isostearic acid.

In embodiments, the hair care composition may include argan oil and conditioners, alone or in combination with other ingredients. Conditioners include, for example, those of natural or synthetic origin, such as those known under the generic CTFA name "Polyquaternium", for instance the MIRAPOL A15® or MIRAPOL 550® polymers from Rhone-Poulenc, cationic polysaccharide derivatives (cationic derivatives of cellulose, of guar or of carob), such as cocodimonium hydroxyethyl cellulose, guar hydroxypropyl trimonium chloride, hydroxypropyl guar hydroxypropyl trimonium chloride (JAGUAR C13S®, JAGUAR C162® sold by Rhone-Poulenc), volatile or non-volatile silicone derivatives, for instance amodimethicone, cyclomethicones, water-insoluble, non-volatile polyorganosiloxanes, for instance oils, resins or gums, such as diphenyldimethicone gums, combinations thereof, and the like.

Examples of other additives which may be useful in the hair care composition include additives for promoting moisturization of the hair and/or skin (wetting agents), for instance certain carbohydrates (for example glycerol or sorbitol), polyethylene glycols or polypropylene glycols, alkoxylated derivatives of sugars or of sugar derivatives (for example methylglucose), water-soluble or water-dispersible polymers such as collagen or certain non-allergenic derivatives of marine or plant proteins (for example wheat protein hydrolysates). Thickeners, such as natural hydrocolloids (guar gum, carob gum, tara gum, etc.) or hydrocolloids derived from fermentation processes, such as xanthan gum, polysaccharides extracted from seaweed, such as carrageenans, and polycarbohydrate derivatives such as modified celluloses (for example hydroxyethylcellulose, carboxymethylcellulose), or nonionic derivatives (for example hydroxypropylguar), anionic derivatives (carboxymethylguar) or nonionic/anionic mixed derivatives, such as carboxy-hydroxypropyl-guars or nonionic/cationic derivatives, can also be present.

Referring still to FIGS. 6-9, the cartridge housing 128 may have a cartridge valve or cover 134 (FIG. 8), which permits access to the first internal chamber 130. The cover 134 may be movable between the closed position and the open position depicted in phantom in FIG. 8 to permit filling/refilling of the treatment agent 132 within the first internal chamber 130 of the cartridge housing 128. The cartridge housing 128 further includes a second internal chamber 136 in fluid communication with the first internal chamber 130. The second internal chamber 136 may have an absorbent member 138 such as a sponge, wicking material or the like, which collects and stores a volume of the treatment agent 132.

The cartridge 108 has an ultrasound emitter or transducer 140 such as a piezo electric transducer or the like. The piezo electric transducer 140 may be any conventional piezo electric transducer adapted to oscillate to generate energy in the form of heat. The transducer 140 may be disc shaped and mounted at each end within opposed channels 142 defined within the cartridge housing 128 adjacent or across a cartridge vapor outlet opening 146 of the cartridge housing 128 (see also FIG. 6). An elastomeric o-ring gasket or seal 148 comprising an elastomeric material or the like may extend within each channel 144 to form a fluid tight seal about the ends of transducer 140. The transducer 140 further includes one or more micro-openings or channels 150 extending therethrough in communication with the second internal chamber 136 to permit release of the vaporized treatment agent.

The cartridge 108 further includes one or more power contacts or pins 152 in electrical communication with the transducer 140. The power pins 152 are received within corresponding power receptacles 154 disposed within the first handle member 102 adjacent the cartridge receiving recess 156 of the first handle member 102 (FIG. 6). The power receptacles 154 include electrical contacts, which are in communication with the ultrasound power switch 124 and the electrical cord 122 to selectively supply power to the transducer 140. Thus, upon mounting of the cartridge 108 fully within the cartridge receiving recess 156 of the first handle member 102, the contact pins 152 of the cartridge 108 establish electrical contact with the contacts within the pin receiving receptacles 154 of the first handle member 102. The cartridge receiving recess 156 is correspondingly dimensioned to accommodate the cartridge 108 in a manner to reduce the profile of the first handle member 102.

Figure 10:
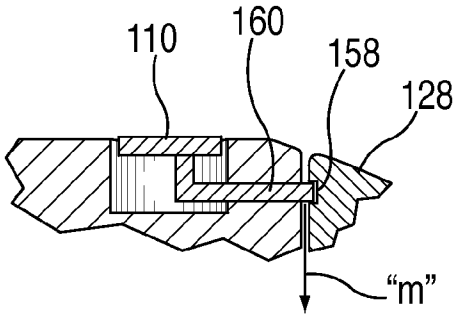
FIG. 10 is a schematic view illustrating a mechanism for releasably mounting the cartridge to the first handle member.

The cartridge housing 128 may have at least one locking detent 158, which is selectively engaged by the cartridge release button 110 to releasably secure the cartridge 108 relative to the first handle member 102. Any type of releasable connection means are envisioned including, e.g., tongue and groove arrangements, bayonet couplings, sliding release arrangements or the like. In one embodiment schematically depicted in FIG. 10, the cartridge release button 110 includes a depending resilient member 160, which is receivable within the locking detent 158 of the cartridge housing 128. Depression of the release button 110 will cause the resilient member 160 to deflect in the direction "m" and become released from the locking detent 158, thereby permitting removal of the cartridge 108 from the cartridge receiving recess 156 of the first handle member 102.

Figure 11:
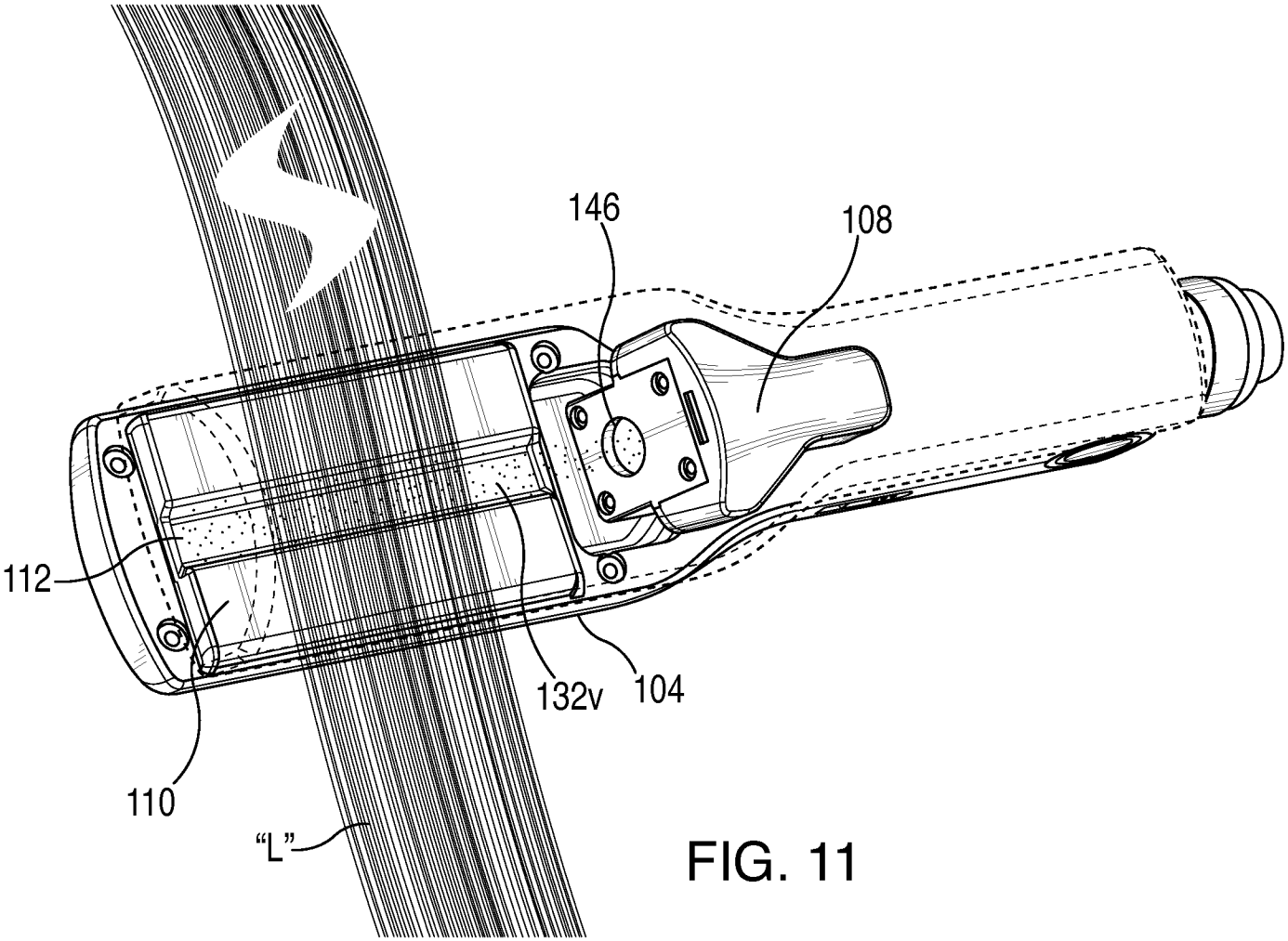
FIG. 11 is a perspective view of the hair styling apparatus with the second handle member removed illustrating application of the vaporized hair treatment agent to the subject's hair.

The use of the hair styling apparatus 100 for styling hair will now be discussed. The cartridge 108 filled with the hair treatment agent 132 is mounted within the outer cartridge receiving recess 156 of the first handle member 102. Electrical contact is established between the contact pins 152 of the cartridge housing 128 and the contacts within the pin receiving receptacles 154 of the first handle member 102. The power switch 118 is activated to charge the heating elements 110 of the first and second handle members 102, 104. The subject's hair is positioned between the open first and second handle members 102, 104 (FIGS. 1 and 2) and the first and second handle members 102, 104 are moved to the closed position of FIGS. 3-5. The hair is treated, e.g., straightened, as it passes along the heating elements 110. When it is desired to apply the hair treatment agent 132, the transducer power switch 124 is activated causing the transducer 140 to oscillate. As the transducer 140 oscillates, heat is generated sufficient to at least partially vaporize the treatment agent 132 within the absorbent member 138 in the second internal chamber 136. As depicted in FIGS. 9 and 11, the vaporized treatment agent "132v" is released through the micro-openings 150 extending through the transducer 140 and out the cartridge vapor outlet opening 146 of the cartridge housing 128. FIG. 11 depicts the first handle member 102 removed for illustration purposes. The vaporized treatment agent "132v" communicates through the opening of the first handle member, and is conveyed through the channels 112 of the first and second handle members 102, 104 for application to the subject's hair. The treatment agent 132v released in the vaporized state from the absorbent or wicking member 138 is continuously replenished with the treatment agent stored within the first internal chamber 130. The ultrasound transducer 140 may be deactivated at any time during the procedure via the ultrasound power switch 124. In the event more treatment agent 132 is needed, the cartridge 108 is released from the first handle member 102 by depression of the cartridge release button 110. The closure seal or cover of the cartridge 134 may be opened, and additional treatment agent 132 is introduced within the first internal chamber 130. The cover 134 is closed and the cartridge 108 is reinserted into the cartridge receiving recess 156 of the first handle member 102.

The wicking or absorbent member 138 maintains the treatment agent in the liquid state adjacent the transducer 140 while preventing the liquid treatment agent from interfering with the functioning of the transducer 140. When subjected to heat generated by the transducer 140, the treatment agent 132 at least partially vaporizes for release through the channels 150 of the transducer 140. The vaporized treatment agent 132*v* will not interfere with the functioning of the transducer. The vaporized treatment agent 132*v* also protects the hair when subjected to the heat of the heating elements 110.

Figures 12A, 12B, 12C:
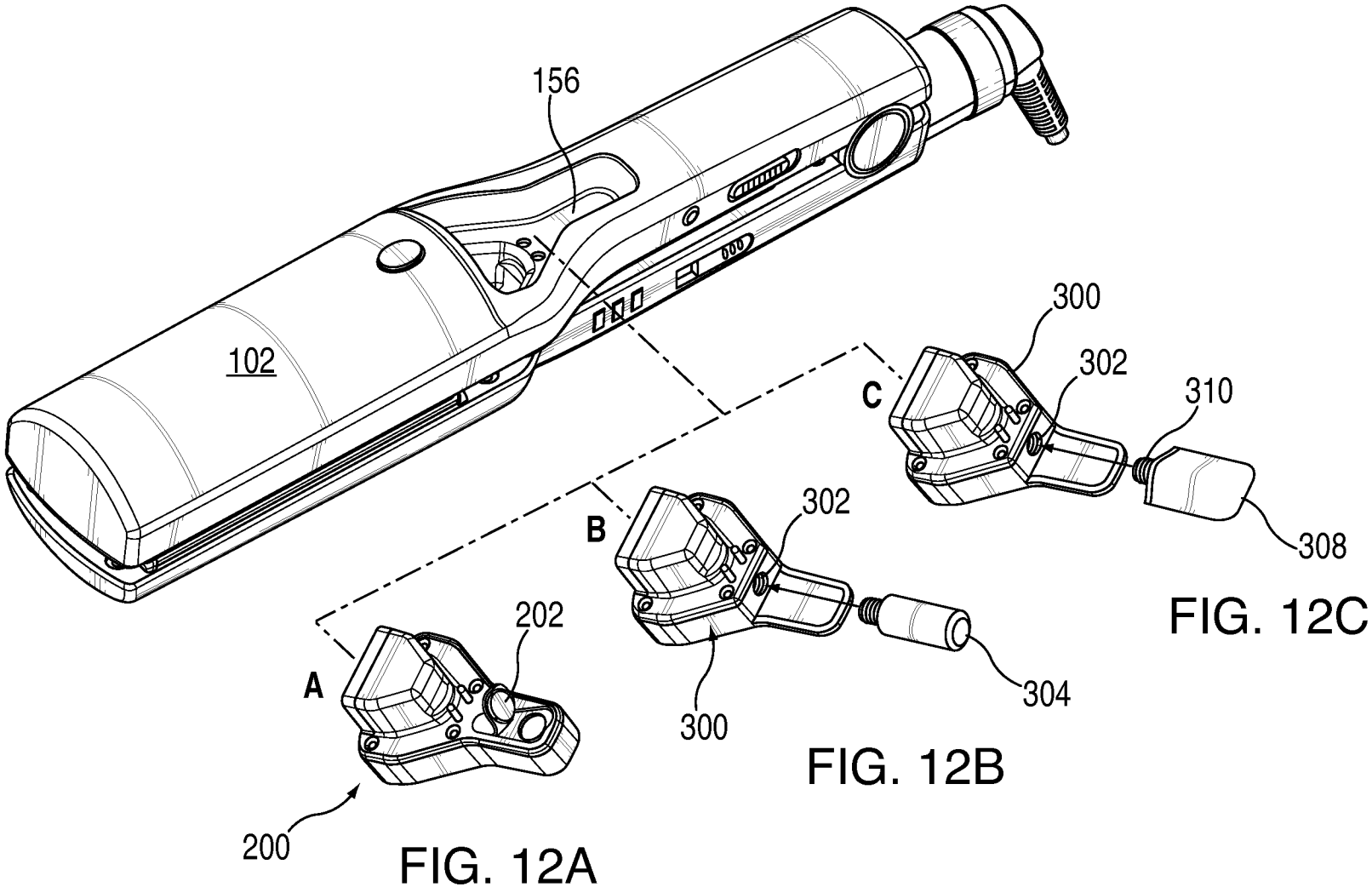
FIGS. 12A-12C are perspective views of three embodiments of the cartridge member illustrated in relation to the hair styling apparatus.

FIGS. 12A-12C illustrate alternate embodiments of the cartridge 108. In FIG. 12A, the cartridge 200 is similar to the cartridge 108 of the first embodiment and incorporates a cover 202 which is selectively opened and closed to permit access to the internal chambers for refilling of the treatment agent. In FIG. 12B, the cartridge 300 includes a threaded opening 302 which receives a threaded bottle member 304 containing the treatment agent. The bottle 304 may replace the first internal chamber and supply the treatment agent to the absorbent member. Upon emptying of the bottle 304, the bottle may be released and replaced with a new bottle of agent or refilled and connected to the cartridge 300. In FIG. 12C, a flexible pouch 308, e.g., a foil pouch, having a threaded segment 310 may be received within the threaded opening 302 of the cartridge 300. Multiple pouches 308 may be provided as replacement pouches during use of the apparatus 100.

The above description and the drawings are provided for the purpose of describing embodiments of the present disclosure and are not intended to limit the scope of the disclosure in any way. It will be apparent to those skilled in the art that various modifications and variations can be made without departing from the spirit or scope of the disclosure. Thus, it is intended that the present disclosure cover the modifications and variations of this disclosure provided they come within the scope of the appended claims and their equivalents.

What is claimed is:

1. A hair styling apparatus, which comprises:

first and second handle members adapted for movement between an open position for receiving hair and a closed position, said first and second handle members cooperating to style hair, at least one of said first and second handles includes a hair heating element for heating hair;

a cartridge mountable to said first handle member, said cartridge having a cartridge housing defining an internal chamber for storing fluid, and at least one outlet in communication with said internal chamber; and a fluid heater element mounted to said cartridge housing, said fluid heater element positioned adjacent said at least one outlet of said cartridge and having a plurality of channels therethrough, said channels defining micro-openings extending through said fluid heater element, said fluid heater element adapted to at least partially vaporize fluid for distribution through said at least one channel and through said at least one outlet of said cartridge for application to the hair.

2. The hair styling apparatus according to claim 1 wherein said cartridge is dimensioned and adapted for releasable mounting to said first handle member to permit removal of said cartridge with said fluid heater element.

3. The hair styling apparatus according to claim 2 including a cartridge release member mounted to said first handle member, said cartridge release member movable to cause release of said cartridge from said first handle member.

4. The hair styling apparatus according to claim 2 wherein said cartridge includes a cover, said cover being movable between an open condition to permit introduction of fluid within said cartridge and a closed condition.

5. The hair styling apparatus according to claim 2 including a fluid within said internal chamber of said cartridge.

6. The hair styling apparatus according to claim 5 wherein said fluid includes a conditioning, strengthening, repairing or revitalizing fluid.

7. The hair styling apparatus according to claim 1 including a manually actuated switch for selectively activating and deactivating said fluid heater element.

8. The hair styling apparatus according to claim 1 including a switch for selectively activating and deactivating said fluid heater element.

9. A hair styling apparatus, which comprises:

first and second handle members adapted for movement between an open position for receiving hair and a closed position, said first and second handle members cooperating to style hair, at least one of said first and second handles includes a hair heating element for heating hair;

a cartridge mountable to said first handle member, said cartridge having a cartridge housing defining an internal chamber for storing fluid, and at least one outlet in communication with said internal chamber; and a fluid heater element mounted to said cartridge housing, said fluid heater element positioned adjacent said at least one outlet of said cartridge and defining at least one micro-opening extending through said fluid heater element, said fluid heater element adapted to at least partially vaporize fluid for distribution through said at least one channel and through said at least one outlet of said cartridge for application to the hair.

10. The hair styling apparatus according to claim 9 wherein said fluid heater element is a transducer.

11. A hair styling apparatus, which comprises:

first and second handle members adapted for movement between an open position for receiving hair and a closed position, said first and second handle members cooperating to style hair, at least one of said first and second handles includes a hair heating element for heating hair;

a cartridge mountable to said first handle member, said cartridge having a cartridge housing defining an internal chamber for storing fluid, and at least one outlet in communication with said internal chamber; and a fluid heater element mounted to said cartridge housing, said fluid heater element positioned adjacent said at least one outlet of said cartridge and defining at least one channel therethrough, said fluid heater element adapted to at least partially vaporize fluid for distribution through said at least one channel and through said at least one outlet of said cartridge for application to the hair, said fluid heater element being an ultrasonic transducer.

12. A hair styling apparatus, which comprises:

first and second handle members adapted for movement between an open position for receiving hair and a closed position, said first and second handle members cooperating to style hair, at least one of said first and second handle members having a hair heating element for heating hair;

a cartridge mountable to said first handle member, said cartridge defining an internal chamber and an outlet in fluid communication with said internal chamber;

a liquid hair treatment agent disposed within said internal chamber of said cartridge, said treatment agent for dispensing through said outlet of said cartridge for treating hair disposed between said first and second handle members;

a fluid heater element associated with said cartridge housing, said fluid heater element adapted to at least partially vaporize said liquid hair treatment agent for distribution through said outlet of said cartridge for application to the hair, said fluid heater element being an ultrasonic transducer and mounted to said cartridge adjacent said outlet; and one of an absorbent or wicking material disposed within said internal chamber for containing said treatment agent.

13. The hair styling apparatus according to claim 12 wherein said one of the absorbent or wicking material is disposed adjacent said outlet whereby heat generated by said fluid heater element causes at least partial vaporization of said treatment agent within said one of said absorbent or wicking material.

14. A hair styling apparatus, which comprises:

at least one handle member dimensioned and adapted to style hair, said at least one handle member having a hair heating element;

a cartridge mountable to said at least one handle member, said cartridge for accommodating a fluid for dispensing and treating hair adjacent said at least one handle member; and an ultrasonic transducer mounted to said cartridge, said transducer actuable to heat said fluid within said cartridge to effect at least partial vaporization thereof for release adjacent said at least one heating member and application to the hair.

15. The hair styling apparatus according to claim 14 wherein said cartridge is dimensioned and adapted for releasable mounting to said first handle member.

16. The hair styling apparatus according to claim 15 wherein said cartridge includes electrical contacts in electrical communication with said transducer, and wherein said at least one handle member includes corresponding handle contacts for engaging said electrical contacts of said cartridge for supplying power to said transducer.

17. The hair styling apparatus according to claim 14 including a fluid within said cartridge.

18. The hair styling apparatus according to claim 17 wherein said fluid includes one of a conditioning, strengthening, repairing or revitalizing fluid.

* * * * *